United States Patent [19]

Clark

[11] 4,424,971

[45] Jan. 10, 1984

[54] CUBE PUZZLE

[76] Inventor: William H. Clark, 7731 West Lake Dr., Lake Clarke Shores, Fla. 33406

[21] Appl. No.: 366,363

[22] Filed: Apr. 7, 1982

[51] Int. Cl.[3] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 416,344 | 12/1889 | Rice | 273/153 S |
| 1,251,400 | 12/1917 | Mees | 273/153 S |
| 1,518,889 | 12/1924 | Wooster | 273/153 S |
| 3,845,959 | 11/1974 | Kosarek | 273/153 S |
| 4,036,503 | 7/1977 | Golick | 273/153 S |

*Primary Examiner*—Anton O. Oechsle

*Attorney, Agent, or Firm*—Louis E. Hay

[57] ABSTRACT

A manipulative cube puzzle having at least one horizontal tier of cubes in which the cubes may be slid, rotated or tumbled at the option of the player, the cubes being marked on at least part of the faces with various colors, letters, numbers, designs or symbols in order to permit the player to arrange the cubes in combinations of varying complexity.

35 Claims, 13 Drawing Figures

CUBE PUZZLE

REFERENCE TO RELATED U.S. PATENTS

U.S. Pat. No. 1,274,294 Game —Lobl—issued July 30, 1918.

U.S. Pat. No. 1,464,424 Puzzle—Hartman—issued Mar. 17, 1921.

U.S. Pat. No. 1,518,889—Wooster—issued Dec. 9, 1924.

U.S. Pat. No. 4,036,503 Puzzle Game—Golick—issued July 19, 1977.

BACKGROUND OF THE INVENTION

Puzzles or games in which a rectangular box or container is divisible into a given number of spaces, and filled with one cube less than the number which would be required to fill the container, are old to the art. The space, which is not occupied by a cube, thus provides a space into which an adjacent cube may be slid, which in turn creates a space having a different location in the container. Initially, the cubes are placed at random, or jumbled; and the object of the game is to manipulate the cubes to a position which will spell words, or arrange the cubes in a numerical sequence. Most of these puzzles have been single tier puzzles, as for example, the first two referenced U.S. patents.

The third referenced U.S. patent is an example of a two tier puzzle in which the faces of the individual cubes are printed or impressed with letters and numerals. The cubes must be arranged in such manner that it is possible to spell certain words and make certain numerical arrangements. Since the cubes cannot be rotated in the container, such a puzzle is limited to a very few possible words and numerical arrangements. The cubes cannot be jumbled in the container at random because the cubes cannot be rotated or tumbled.

The last referenced U.S. patent is an example of a cube puzzle having a preferred embodiment of five cubes in a container with six spaces. If this puzzle is laid on its side, it is a single tier puzzle. Internally, the container is enough larger that it is possible by tilting, tapping and otherwise manipulating the container, to slide, rotate and tumble a cube. As is clearly stated in the patent, there is always an element of chance because the operator or player is never in full control of the cubes, and he may or may not make a cube act in accordance with his desire.

The last two referenced patents teach puzzles which are in closed containers. Once the desired alignment of the cubes has been attained, it is nearly as time consuming to completely disarrange the cubes as it was to align them in their desired game pattern.

SUMMARY OF THE INVENTION

A cube puzzle in accordance with the present invention may have one or more tiers of cubes, depending on the species and on the desired complexity. The puzzle is configured to permit sliding a cube into a vacant space by linear movement, to permit the repetitive tumbling of a cube about an edge of the cube, from one face to an adjacent face, on a horizontal or X—X axis, and to permit the repetitive tumbling of the cube about an edge of the cube, from one face to an adjacent face, on the vertical or Y—Y axis.

If desired, and to assist in tumbling a cube, one species of the present invention uses a retractable pin which may be thrust into the puzzle to form an obstruction adjacent to the edge about which a cube is being tumbled. The cube is caused to trip over the obstruction, and causing it to tumble in much the same manner that a person will tumble when tripping on an unseen obstruction. Another species of the invention uses a retractable slide for the same purpose as the pin.

The tumbling action may be repeated on both the X—X and Y—Y axes. Regardless of the random manner in which the cubes are loaded in the container, any one of the six sides on any cube may be made to align in any manner desired by the player. For example, a simple cube puzzle having a single tier may be divisible into nine spaces and contain eight cubes, the sides of which are each painted with a different color. The cubes may be manipulated until all cubes have the same color visible on the top side, for example. Another example would be to create a checkerboard effect with two alternating colors visible on the top side of the puzzle.

The complexity of the game may be increased without limit by increasing the number of cubes in a tier, and by increasing the number of tiers. For example, the solution may require certain combination of markings to appear on two adjacent sides of the container, as for example, the top side and an adjacent side. Thus, if the puzzle has three tiers of cubes, this would require the correct positioning of cubes on a vertical tier in addition to the correct positioning on a horizontal tier.

DESCRIPTION OF THE PREFERRED EMBODIMENT

Figure 1:
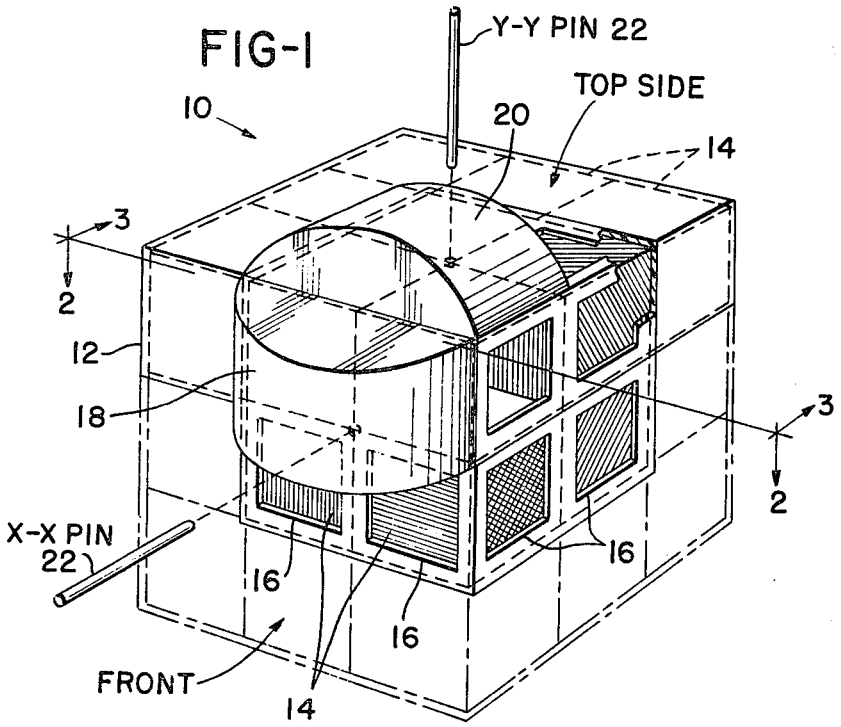
FIG. 1 is a perspective of the first species of the cube puzzle with the solid lines depicting a puzzle having a single tier of cubes, and with the phantom lines depicting the puzzle enlarged to contain three tiers of cubes.

For purposes of the present invention, the box structures which house the cubes are defined as being of parallelepipedon form and oriented to the attitude depicted in the drawings. Each box structure (with the exception of FIG. 12) is defined as having four vertical sides, a horizontal top side and a horizontal bottom side. The interior of the box structure is defined as a hollow rectangular interior, which term includes a cubical interior.

Figure 2:
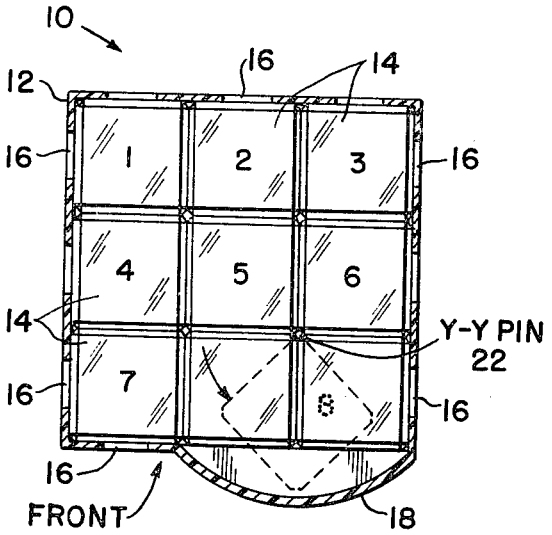
FIG. 2 is a plan cross-section taken along the line 2—2 of FIG. 1, with the dotted lines depicting a cube being tumbled on the vertical or Y—Y axis in the horizontal tumble chamber.
Figure 3:
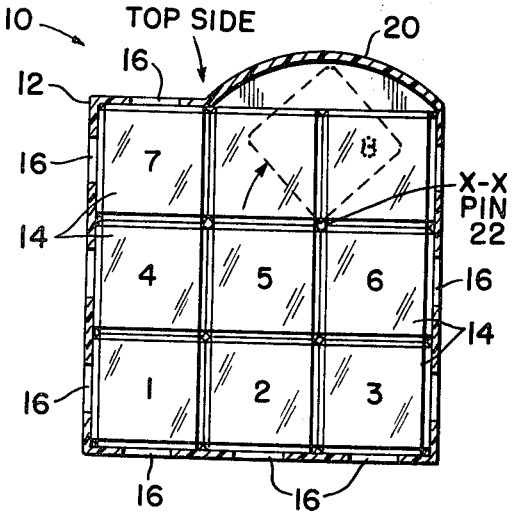
FIG. 3 is an elevation cross-section taken along the line 3—3 of FIG. 1, with the dotted lines depicting a cube being tumbled on the horizontal or X—X axis in the vertical tumble chamber.

The first species of the present invention is depicted in FIGS. 1-3. The puzzle may have one or more horizontal tiers of uniformly sized cubes, with each tier having the capacity for housing the same number of cubes. The solid lines of FIG. 1 represent a single tier puzzle, and the phantom lines add two additional tiers for a total of three tiers. For purposes of further illustration and description, the three tier puzzle will be used.

Although, as depicted, the puzzle of FIG. 1 has the capacity for containing or housing 9 cubes in each of the three tiers, and is of cubic form, other rectangular arrangements may be used within the scope of the invention. For example, the puzzle may have two tiers, each tier of which may contain three cubes in the lateral direction, and more than three cubes in the longitudinal direction.

The cube puzzle 10 has a hollow container or box structure 12 having a rectangular interior for housing or containing in slidable relationship a predetermined number of uniformly sized cubes 14 in one or more horizontal and vertical tiers. The number of cubes is preferably one less than the capacity of the interior portion of the box structure 12; however, fewer cubes may be used within the scope of the invention. For example, the puzzle depicted in FIG. 1 has a capacity for 27 cubes. The preferred number of cubes is 26; however, 25 or even fewer cubes may be housed in the puzzle.

As indicated in FIG. 1, the faces of the cubes are of various colors. Other indicia, such as numerals, letters of the alphabet, or abstract symbols may be used. All the faces on a cube need not be imprinted with the same indicia.

The box structure 12 is provided with apertures 16 which are positioned to be in register with at least part of the peripheral cubes. The apertures may be square as depicted, or, they may be round if desired. The only requirement is that they must not be large enough to permit escape of the cubes from the puzzle. The primary function of the apertures is to permit a player to use his fingers for applying enough pressure to prevent movement of certain cubes in some situations, and to slide cubes when desired.

The box structure 12 has an integral horizontal arched alcove 18 and a vertical arched alcove 20. The purpose of the alcoves is to form tumble chambers in which a cube may be rotated or tumbled 90 degrees about one edge thereon. In other words, a cube is rotated from one face to an adjacent face in a given attitude. By use of the correct tumble chamber, a cube may be rotated on either the horizontal or X—X axis, or, it may be rotated on the vertical or Y—Y axis. The tumbling or rotation of a cube is illustrated in FIGS. 2 and 3.

FIG. 2 is a plan cross-section through the top tier of the cubes of the puzzle depicted in FIG. 1. FIG. 2 illustrates the movement of a tumbling cube about the vertical or Y—Y axis. The cube is rotated in the horizontal tumble chamber formed by the horizontal alcove 18. In order to more clearly visualize and describe the manner in which a cube is tumbled, the cubes of the pertinent horizontal tier in FIG. 2 and the pertinent vertical tier in FIG. 3 have been numbered cubes 1-8. The cubes to be tumbled are number 8 on which the numerals are shown dotted to correspond with the dotted outline of the cubes.

The normal sliding position would be for cube 8 to be in normal register with the other cubes in the tier; that is, cube 8 would be abutting against cube 5 and cube 7. In such abutting position, cube 8 would be free to slide to the right into the adjacent unnumbered position to the right in both FIGS. 2 and 3. The visible unnumbered cube below cube 8 is actually a cube in the next tier of cubes, and is not in the tier having the numbered cubes; thus, there is an unfilled or vacant space into which cube 8 may slide, or into which cube 8 may be tumbled.

Each tumble chamber spans the space occupyable by two cubes, is in register with the cubes in the tier, and is of such internal dimensions as will allow free sliding movement of the cube to be rotated. As depicted in both FIGS. 2 and 3, the internal radius of curvature of the arched end of the tumble chambers is slightly greater than the diagonal dimension across the face on a cube to permit the cube to tumble about that edge thereon which acts as the center of rotation.

In order to assist in tumbling a cube, an obstruction is formed over which the tumbling cube may be tripped. In the species depicted in FIG. 1, the obstruction may be formed by a pin 22 which may be retractably thrust into box structure 12 to be adjacent to the edge of the cube, about which edge the cube is being tumbled. The pin 22 may be a simple pin, in fact it may even be a small nail or a brad which are readily available; or, it may take the form of a spring biased plunger pin such as is well known to the art and requires no further description. If a simple pin is used, the pin would enter through a properly located aperture in the box structure. If a spring biased plunger pin is used, it may be made integral with the box structure; or, the assembly may be mounted by methods well known to the art, such as by the use of contact cement.

Figure 9:
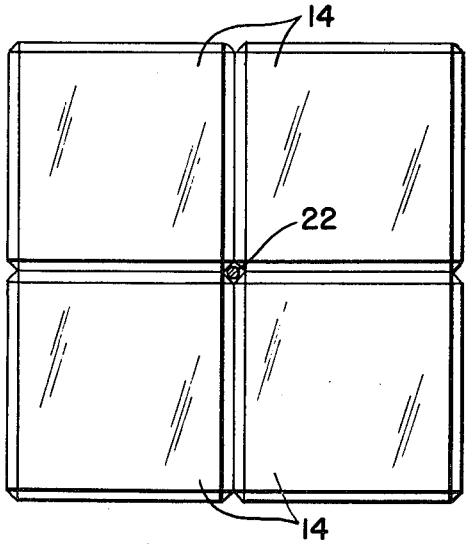
FIG. 9 is an enlarged view of four abutting cubes.

The ideal location for a pin is to have the longitudinal axis of the pin at the intersection of four abutting cubes, as illustrated in FIG. 9. This ideal position may be achieved by chamfering the edges of the cubes as illustrated in FIG. 9 in order to provide an unoccupied space into which the pin 22 may be thrust. The unoccupied space may also be provided by relieving the edges of the cubes with a radius. Cubes of this type are not only preferred when using a pin 22, but also when using a slide as depicted in the second species of the puzzle as depicted in FIGS. 4-8.

Assuming now that it is desired to tumble the cube 8 depicted in FIG. 2 about the vertical of Y—Y axis, and that the cube 8 is abutting against cubes 5 and 7 in normal position. The player would rotate the puzzle to place the tumble chamber 18 into an upward extending attitude. The player would then thrust the Y—Y axis pin 22 into the box structure and then tilt the puzzle in the proper downward direction which will cause cube 8 to trip on the pin and rotate in the indicated direction. With the pin adjacent to cube 8 in its position abutting against cubes 5 and 7, the cube 8 is restrained from sliding into the vacant position in the tumble chamber; the cube will tumble into the vacant position.

If it is desired to tumble a cube 180 degrees, the pin 22 is retracted, and the cube 8 is slid into its normal position to again abut against cubes 5 and 7. Tumbling cube 8 a second time will have rotated the cube 180 degrees from its original attitude.

The vertical tumble chamber 20 functions in the same manner when the X—X axis pin 22 is thrust into the box structure. As depicted in FIG. 3, the vertical tumble chamber 20 is in an upward extending attitude, and it is only necessary to tilt the puzzle downward in the proper direction to tumble cube 8 on the horizontal or X—X axis. The cube may be tumbled 180 degrees in the manner described above.

By proper use of the horizontal and vertical tumble chambers, any face on any cube may be manipulated to face any desired direction.

Within the scope of the invention, the most simple embodiment of the species described above would be to have a single tier of cubes and a single arched alcove forming a single tumble chamber. Another simple embodiment would be to have two horizontal tiers of cubes and a single horizontal tumble chamber in register with the cubes in one of the tiers. Still another simple embodiment would be to have a single horizontal tier of cubes, a horizontal tumble chamber and a vertical tumble chamber.

A cube puzzle in accordance with any one of the species of the present invention does not involve an element of chance because the tumbling of a cube is accomplished with mechanical certainty, and not by tapping and jostling the puzzle in hope of tumbling a cube in the desired direction. The player at all times is in full control of each cube.

A second species of the present invention is depicted in FIGS. 4–8. The functional purpose of the second species remains the same as in the first species described above. The principal difference between the two species is in the construction of the tumble chambers, and in the substitution of slides for the pins.

Figure 4:
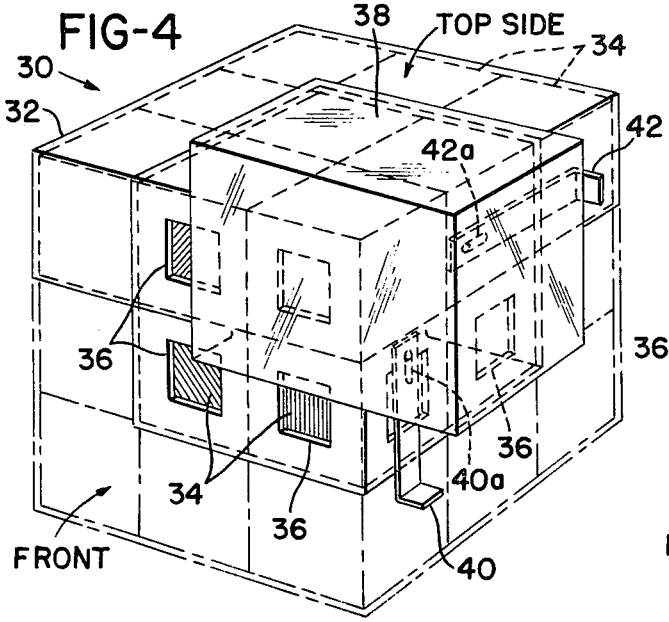
FIG. 4 is a perspective of a second species of the invention, comparable to the first species depicted in FIG. 1, the principal difference being to combine the two arched alcoves of FIG. 1 into a single rectangular alcove, and to change the configuration of the tripping means.

The cube puzzle 30 is depicted in perspective in FIG. 4. The solid lines depict a box structure having a single horizontal tier of cubes. The phantom lines add an additional two tiers of cubes for a total of three horizontal tiers of cubes.

Figure 6:
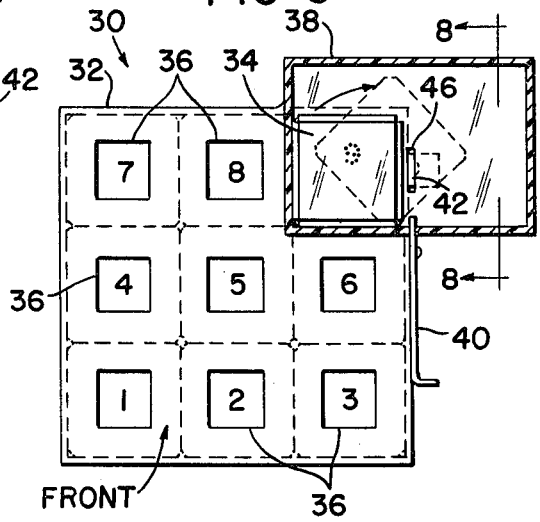
FIG. 6 is a vertical cross-section taken along the line 6—6 of FIG. 5 and depicting a cube being tumbled on the horizontal or X—X axis.
Figure 5:
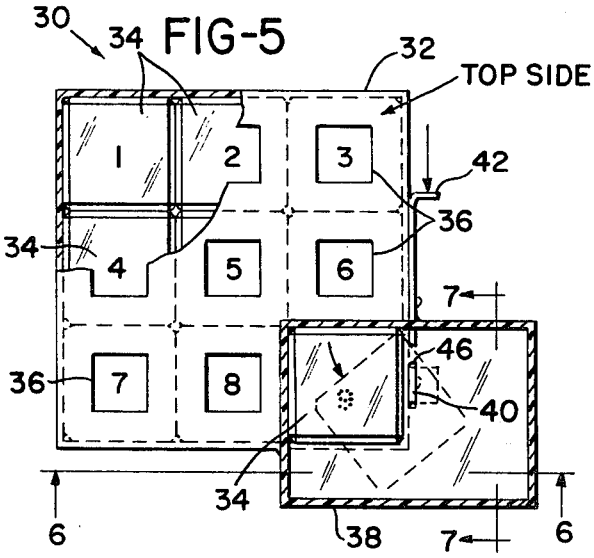
FIG. 5 is a plan view in cross-section taken through the top tier of cubes in FIG. 4 and depicting a cube being tumbled on the vertical or Y—Y axis.

For purposes of illustration in FIGS. 4–6, and for further description, the three tier puzzle will be used. Although the puzzle is depicted with a cubic arrangement of cubes, other rectangular arrangements may be used within the scope of the invention. For example, the puzzle may have two horizontal tiers, each having three cubes in one direction and more than three cubes in the other direction.

FIG. 4 depicts a puzzle having three tiers, each containing 9 cubes for a total of 27 cubes. Within the scope of the invention, a predetermined number of cubes up to the maximum number for the capacity of the rectangular interior of the box structure may be used. In the present illustration, the maximum number would be 27 cubes; however, 26 cubes or even a lesser number of cubes may be used.

The cube puzzle 30 has a box structure 32 having a hollow rectangular interior portion housing a predetermined number of cubes 34. As indicated in FIG. 4, the faces of the cubes are of various colors; however, other indicia may be used. The interior portion of the box structure is of such size as will permit the free sliding movement of the cubes. Each cube should preferably have its edges relieved by chamfers or otherwise, for reasons previously stated. The box structure 32 is also provided with a plurality of apertures 36 in register with at least a portion of the peripheral cubes for reasons previously stated.

The box structure is provided with a rectangular alcove 38 at one corner of the box structure as illustrated in FIG. 4, and as shown in cross-section in FIGS. 5 and 6. The alcove 38 is located to be in register, both horizontally and vertically, with a corner cube in the top tier of cubes, and is slightly more than twice the width of a cube in length. The alcove forms a tumble chamber in which the corner cube may be tumbled both horizontally and vertically. As depicted in FIG. 5, the width of the tumble chamber is slightly more than the diagonal dimension of the face on a cube in order to provide clearance when the cube is being tumbled about the vertical or Y—Y axis. As indicated in FIG. 6, the height of the tumble chamber is slightly more than the diagonal dimension of the face on a cube in order to provide clearance when the cube is being tumbled on the horizontal or X—X axis.

The alcove or tumble chamber 38, as depicted, is slightly longer than the width of two cubes. If desired, the alcove may be made longer in order to provide temporary storage for one or more cubes, which will provide the remaining cubes with greater maneuverability.

Whereas the first species described above used pins to provide an obstruction in the tumble chambers, the second species uses slides. A first slide 40 provides obstruction when tumbling a cube on the horizontal or X—X axis, and a second slide 42 provides obstruction when tumbling on the vertical or Y—Y axis. The slides may be externally mounted on the box structure by one of several well known methods, for which reason the mounting methods require no specific description.

Figure 7:
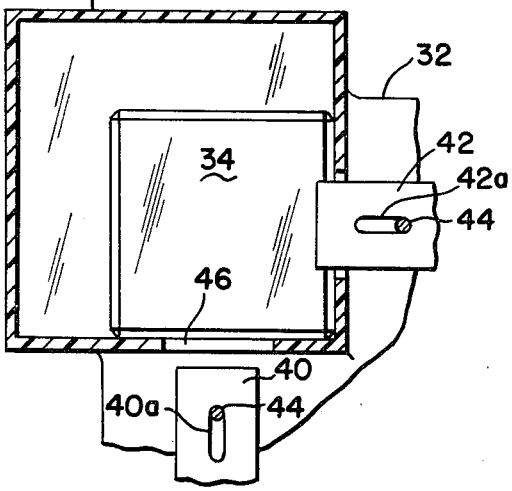
FIG. 7 is an enlarged section taken along the line 7—7 of FIG. 5.
Figure 8:
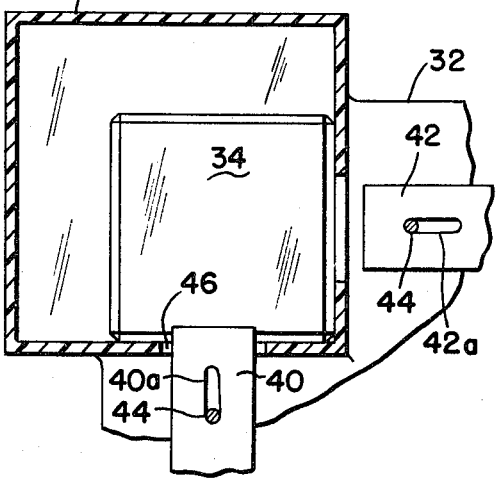
FIG. 8 is an enlarged section taken along the line 8—8 of FIG. 6.

The slides 40 and 42 are provided with elongated slots **40*a* and 42*a* which are in register with limit pins 44. The two slides may be retractably thrust into the alcove or tumble chamber 38 through apertures 46 as best illustrated in FIGS. 7 and 8. The limit pins 44, acting in slots 40*a* and 42*a*, limit the position of the two slides in the thrust and the retracted position as indicated in FIGS. 7 and 8. The relative position of the slides 40 and 42, when tumbling a cube on the vertical or Y—Y axis, is shown in FIG. 7. The relative position of the slides 40 and 42, when tumbling a cube on the horizontal or X—X axis, is shown in FIG. 8**. If desired, and within the scope of the present invention, the depicted slides may be replaced by other means, such as pivoted levers or gates which perform the same function as the slides.

Figure 10:
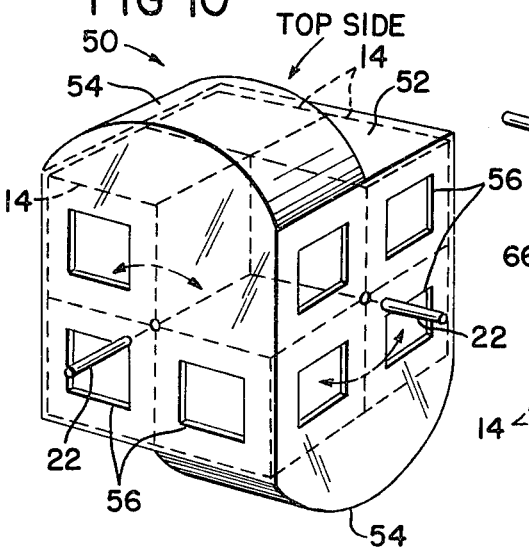
FIG. 10 is a perspective of a variation of the first species.

Specific reference is made to FIG. 10 which is a variation of the species depicted in FIG. 1. The cube puzzle 50 has a box structure 52 in parallelepipedon form as previously described, and houses 7 cubes in two tiers within a cubical interior having a capacity for 8 cubes. The puzzle 50 has two arched alcoves 54 on opposing horizontal sides, and at right angle with each other. The internal size of the alcoves and their register in relation with the cubes is as previously described. The puzzle also has apertures 56 which are positioned as, and for the purposes previously described. In order to assist in tumbling a cube, an obstruction is formed over which the tumbling cube may be tripped. The obstruction may be formed by pin 22 which was previously fully described in the description on FIG. 1. The cube puzzle depicted in FIG. 10 is preferably made with not less than two tiers; however, it may have capacity for more than 4 cubes per tier.

Figure 11:
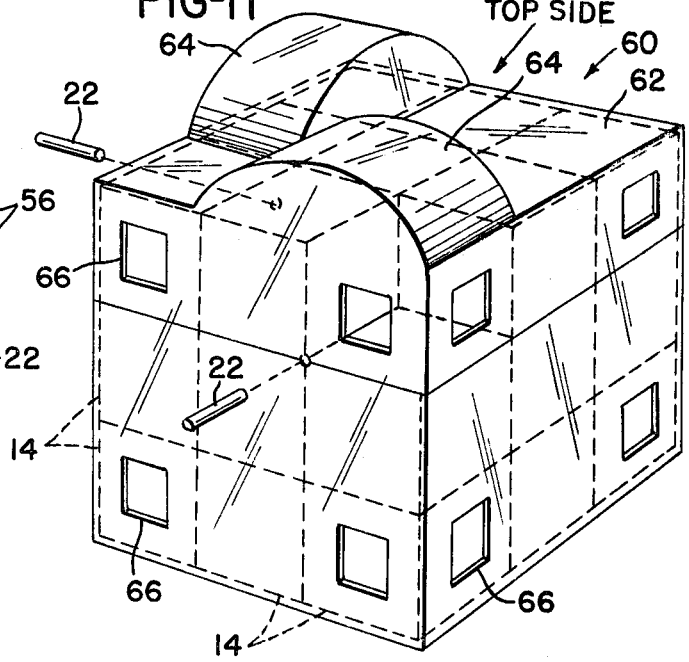
FIG. 11 is a perspective of another variation of the first species.

Specific reference is now made to FIG. 11 which depicts another variation of the species depicted in FIG. 1. Cube puzzle 60 has a box structure 62 in parallelepipedon form as previously described. The principal variation is that the two alcoves 64 extend from the same horizontal side, and are oriented to be 90 degrees with each other. The puzzle also has apertures 66 which are positioned as previously described. In order to assist in tumbling a cube, an obstruction is formed over which the tumbling cube may be tripped. The obstruction may be formed by pin 22 which was previously described in the description on FIG. 1. This variation of the puzzle may be made in either single or multi-tier configuration. Each tier may contain 4 or more cubes, with the total being a predetermined number at least one less than the capacity of the rectangular interior of the box structure.

Figure 12:
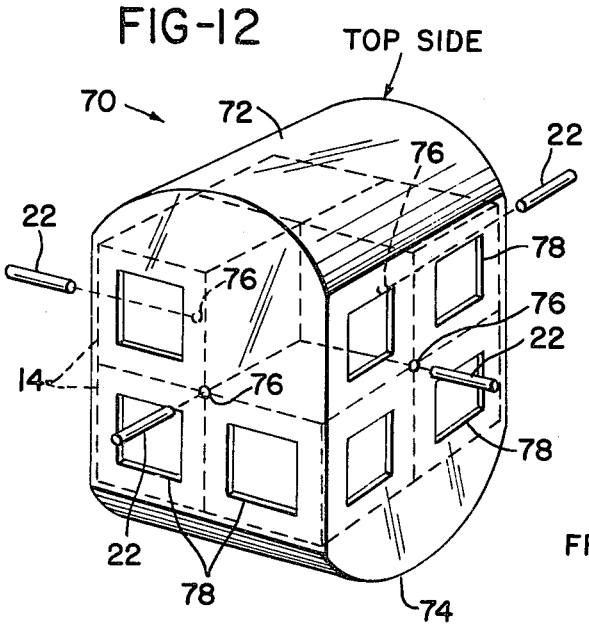
FIG. 12 is a perspective of yet another variation of the first species; and, FIG. 13 is a perspective of a third species of the puzzle.

Specific reference is made to FIG. 12 which depicts a cube puzzle 70 having two tiers, each of which is divisible into 4 spaces for a total of 8 spaces containing 7 cubes. The puzzle is provided with a first arched tumble chamber 72 which forms an entire side of the box structure. The opposing side of the box structure constitutes a second arched tumble chamber 74 at right angle to the first tumble chamber 72. A single retractable pin 22 may be used at any of the four apertures 76 as illustrated in FIG. 12. Only one cube requires sliding into a vacant space before another cube may be tumbled. Apertures 78, as previously described, are in register with the cubes.

Figure 13:
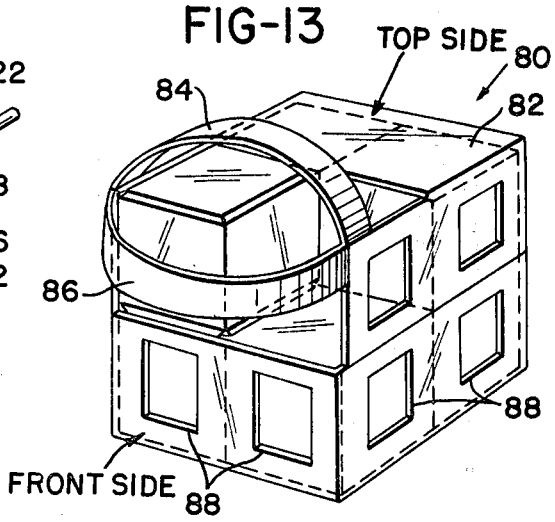

Specific reference is now made to FIG. 13 which depicts a third species of the present invention; one which does not use pins or slides. The cube puzzle 80 has two tiers, each of which is divisible into 4 spaces for a total of 8 spaces. The puzzle, as illustrated, contains a predetermined number of cubes, preferably 7. More than two tiers may be used, and each tier may have capacity for more than 4 cubes. The box structure 82, as depicted, is of cubic shape with one-half of the top side and one-half of the adjacent front side cut away as illustrated. A first relatively narrow arched band 84 forms the functional equivalent of one of the closed arched tumble chambers in the species depicted in FIG. 1; and, a second relatively narrow arched band 86 forms another functional equivalent of the other closed arched tumble chamber. The ends of the two arched bands are joined to the side walls of the box structure at the corner intersections of the cut-out portion of the box structure, and at right angle to each other to form open-sided tumble chambers, each with a span of two cubes and a radius of curvature slightly greater than the diagonal dimension on the face of a cube. There is enough space in the openings to reach in and tumble the cubes on both the horizontal and vertical axes by using a finger, or an object such as the eraser on the end of a pencil. The puzzle may be provided with apertures 88 as previously described.

It is to be understood that the embodiments of the present invention as shown and described are to be regarded merely as illustrative, and that the invention is susceptible to variations, modifications and changes, without regard to specific construction methods, within the scope of the appended claims.

I claim:

1. A cube puzzle manipulative by a player, said cube puzzle comprising: a box structure of parallelepipedon form and having a hollow rectangular interior housing in slidable relationship a predetermined number of uniformly sized cubes in at least one tier, the number of cubes being at least one less than the housing capacity of said rectangular interior, said box structure having at least one hollow arched alcove extending outward from at least one side of said rectangular interior, each of said alcoves being in internal register with and spanning the space occupyable by two of said cubes abutting in face-to-face relationship contiguous with an edge of said rectangular interior, each of said alcoves having an interior width slightly greater than the width of a cube, and with the internal radius of curvature of the arched end on each of said alcoves being slightly greater than the diagonal dimension of a face on one of said cubes, each of said alcoves forming a tumble chamber for tumbling a selected cube from one face to an adjacent face thereon at the option and control of said player.

2. A cube puzzle in accordance with claim 1 in which each of said alcoves is in register with the space occupyable by two of said cubes nearest a corner in the rectangular interior of said box structure.

3. A cube puzzle in accordance with claim 1 in which said box structure contains a plurality of apertures in register with at least a portion of said cubes.

4. A cube puzzle manipulative by a player, said cube puzzle comprising: a box structure of parallelepipedon form having four vertical sides, a top horizontal side and a bottom horizontal side forming a hollow rectangular interior housing in slidable relationship a predetermined number of uniformly sized cubes stacked in at least two tiers, the number of cubes being at least one less than the housing capacity of said rectangular interior, said box structure having at least two hollow arched alcoves extending from at least one side of said rectangular interior, each of said alcoves being in internal register with and spanning the space occupyable by two of said cubes abutting in face-to-face relationship contiguous with an edge of said rectangular interior, each of said alcoves having an interior width slightly greater than the width of a cube, and with an internal radius of curvature of the arched end on each of said alcoves being slightly greater than the diagonal dimension of a face on one of said cubes, each of said alcoves forming a tumble chamber for tumbling a selected cube from one face to an adjacent face thereon at the option and control of said player.

5. A cube puzzle in accordance with claim 4 in which at least one of said alcoves extends from one of the vertical sides of said box structure, and at least one of said alcoves extends from one of the horizontal sides of said box structure.

6. A cube puzzle in accordance with claim 5 in which said box structure contains a plurality of apertures in register with at least a portion of said cubes.

7. A cube puzzle in accordance with claim 4 in which each of said alcoves is in register with the space occupyable by two of said cubes nearest a corner in the rectangular interior of said box structure.

8. A cube puzzle in accordance with claim 7 in which said box structure contains a plurality of apertures in register with at least a portion of said cubes.

9. A cube puzzle in accordance with claim 4 in which each of said alcoves extending from a vertical side of said box structure and each of said alcoves extending from a horizontal side of said box structure are in register with a space occupyable by two of said cubes nearest a corner in the rectangular interior of said box structure.

10. A cube puzzle in accordance with claim 9 in which said box structure contains a plurality of apertures in register with at least a portion of said cubes.

11. A cube puzzle in accordance with claim 4 in which said box structure contains a plurality of apertures in register with at least a portion of said cubes.

12. A cube puzzle manipulative by a player, said cube puzzle comprising: a box structure of parallelepipedon form and having a hollow rectangular interior housing in slidable relationship a predetermined number of uniformly sized cubes in at least one tier, the number of cubes being at least one less than the housing capacity of said rectangular interior, said box structure having at least one hollow arched alcove extending outward from at least one side of said rectangular interior, each of said alcoves being in internal register with and spanning the space occupyable by two of said cubes abutting in face-to-face relationship contiguous with an edge of said rectangular interior, each of said alcoves having an interior width slightly greater than the width of a cube, and with the internal radius of curvature of said arched end on each of said alcoves being slightly greater than the diagonal dimension of a face on one of said cubes, each of said alcoves forming a tumble chamber for tumbling a selected cube; and, tripping means adapted for retractably thrusting into said box structure to provide an obstruction near the edge of said selected cube about which edge said cube is being tumbled, said tumbling cube tripping over said obstruction and rotating from one face to an adjacent face thereon at the option and control of said player.

13. A cube puzzle in accordance with claim 12 in which each of said alcoves is in register with the space occupyable by two of said cubes nearest a corner in the rectangular interior of said box structure.

14. A cube puzzle in accordance with claim 12 in which said box structure contains a plurality of apertures in register with at least a portion of said cubes.

15. A cube puzzle manipulative by a player, said cube puzzle comprising: a box structure of parallelepipedon form having four vertical sides, a top horizontal side and a bottom horizontal side forming a hollow rectangular interior housing in slidable relationship a predetermined number of uniformly sized cubes stacked in at least two tiers, the number of cubes being at least one less than the housing capacity of said rectangular interior, said box structure having at least two hollow arched alcoves extending from at least one side of said rectangular interior, each of said alcoves being in internal register with and spanning the space occupyable by two of said cubes abutting in face-to-face relationship contiguous with an edge of said rectangular interior, each of said alcoves having an interior width slightly greater than the width of a cube, and with an internal radius of curvature of the arched end on each of said alcoves being slightly greater than the diagonal dimension of a face on one of said cubes, each of said alcoves forming a tumble chamber for tumbling a selected cube; and, tripping means adapted for retractably thrusting into said box structure to provide an obstruction near the edge of said selected cube about which edge said cube is being tumbled, said tumbling cube tripping over said obstruction and rotating from one face to an adjacent face thereon at the option and control of said player.

16. A cube puzzle in accordance with claim 15 in which at least one of said alcoves extends from one of the vertical sides of said box structure, and at least one of said alcoves extends from one of the horizontal sides of said box structure.

17. A cube puzzle in accordance with claim 16 in which said box structure contains a plurality of apertures in register with at least a portion of said cubes.

18. A cube puzzle in accordance with claim 15 in which each of said alcoves is in register with the space occupyable by two of said cubes nearest a corner in the rectangular interior of said box structure.

19. A cube puzzle in accordance with claim 18 in which said box structure contains a plurality of apertures in register with at least a portion of said cubes.

20. A cube puzzle in accordance with claim 15 in which each of said alcoves extending from a vertical side of said box structure and each of said alcoves extending from a horizontal side of said box structure are in register with a space occupyable by two of said cubes nearest a corner in the rectangular interior of said box structure.

21. A cube puzzle in accordance with claim 20 in which said box structure contains a plurality of apertures in register with at least a portion of said cubes.

22. A cube puzzle in accordance with claim 15 in which said box structure contains a plurality of apertures in register with at least a portion of said cubes.

23. A cube puzzle manipulative by a player, said cube puzzle comprising: a box structure of parallelepipedon form having four vertical sides, a top horizontal side and a bottom horizontal side forming a hollow rectangular interior housing in slidable relationship a predetermined number of uniformly sized cubes in a single horizontal tier, the number of said cubes being to the maximum of the housing capacity of the rectangular interior portion of said box structure, said box structure having a horizontally and vertically extending rectangular alcove, one end of which is in horizontal and vertical register with a corner cube in the interior portion of said box structure, and with the internal horizontal and vertical dimensions of said alcove being slightly greater than the diagonal dimension of a face on one of said cubes, and with the internal length of said alcove being at least slightly greater than the length of two cubes in face-to-face abutting relationship, said alcove forming a tumble chamber for tumbling said corner cube from one face to an adjacent face thereon at the option and control of said player.

24. A cube puzzle in accordance with claim 23 in which said box structure contains a plurality of apertures in register with at least a portion of said cubes.

25. A cube puzzle manipulative by a player, said cube puzzle comprising: a box structure of parallelepipedon form having four vertical sides, a top horizontal side and a bottom horizontal side forming a hollow rectangular interior housing in slidable relationship a predetermined number of uniformly sized cubes in at least two horizontal tiers, the number of said cubes being to the maximum of the housing capacity of the rectangular interior of said box structure, said box structure having a horizontally and vertically extending rectangular alcove, one end of which is in horizontal and vertical register with a corner cube in the top tier of cubes in the rectangular interior of said box structure, and with the internal horizontal and vertical dimensions of said alcove being slightly greater than the diagonal dimension of a face on one of said cubes, and with the internal length of said alcove being at least slightly greater than the length of two cubes in face-to-face abutting relationship, said alcove forming a tumble chamber for tumbling said corner cube from one face to an adjacent face thereon at the option and control of said player.

26. A cube puzzle in accordance with claim 25 in which said box structure contains a plurality of apertures in register with at least a portion of said cubes.

27. A cube puzzle manipulative by a player, said cube puzzle comprising: a box structure of parallelepipedon form having four vertical sides, a top horizontal side and a bottom horizontal side forming a hollow rectangular interior housing in slidable relationship a predetermined number of uniformly sized cubes in a single horizontal tier, the number of said cubes being to the maximum of the housing capacity of the rectangular interior of said box structure, said box structure having a horizontally and vertically extending rectangular alcove, one end of which is in horizontal and vertical register with a corner cube in the rectangular interior of said box structure, and with the internal horizontal and vertical dimensions of said alcove being slightly greater than the diagonal dimension of a face on one of said cubes, and with an internal length of said alcove being at least slightly greater than the length of two cubes in face-to-face abutting relationship, said alcove forming a tumble chamber for tumbling said corner cube; and, tripping means adapted for retractably thrusting into said box structure to provide an obstruction near the edge of said selected corner cube about which edge said cube is being tumbled, said tumbling cube tripping over said obstruction and rotating from one face to an adjacent face thereon at the option and control of said player.

28. A cube puzzle in accordance with claim 27 in which said box structure contains a plurality of apertures in register with at least a portion of said cubes.

29. A cube puzzle manipulative by a player, said cube puzzle comprising: a box structure of parallelepipedon form having four vertical sides, a top horizontal side and a bottom horizontal side forming a hollow rectangular interior housing in slidable relationship a predetermined number of uniformly sized cubes in at least two horizontal tiers, the number of said cubes being to the maximum of the housing capacity of the rectangular interior of said box structure, said box structure having a horizontally and vertically extending rectangular alcove, one end of which is in horizontal and vertical register with a corner cube in the top tier of cubes in the rectangular interior of said box structure, and with the internal horizontal and vertical dimensions of said alcove being slightly greater than the diagonal dimension of a face on one of said cubes, and with the internal length of said alcove being at least slightly greater than the length of two cubes in face-to-face abutting relationship, said alcove forming a tumble chamber for tumbling said corner cube; and, tripping means for retractably thrusting into said alcove to provide an obstruction near the edge of said tumbling cube about which edge said cube is being tumbled, said tumbling cube tripping over said obstruction and rotating from one face to an adjacent face thereon at the option and control of said player.

30. A cube puzzle in accordance with claim 29 in which said box structure contains a plurality of apertures in register with at least a portion of said cubes.

31. A cube puzzle manipulative by a player, said cube puzzle comprising: a box structure of parallelepipedon form having four vertical sides, a top horizontal side and a bottom horizontal side forming a hollow rectangular interior housing in slidable relationship a predetermined number of uniformly sized cubes in at least one horizontal tier, the number of cubes being at least one less than the housing capacity of said rectangular interior, said box structure having a first hollow arched alcove extending upward from the top side of said rectangular interior and a second hollow arched alcove extending downward from the bottom side of said rectangular interior and at right angle to said first alcove, each of said alcoves being in internal register with and spanning the space occupyable by two of said cubes abutting in face-to-face relationship contiguous with an edge of said rectangular interior, each of said alcoves having an interior width slightly greater than the width of a cube, and with the internal radius of curvature of the arched end on each of said alcoves being slightly greater than the diagonal dimension of a face on one of said cubes, each of said alcoves forming a tumble chamber for tumbling a selected cube from one face to an adjacent face thereon at the option and control of said player.

32. A cube puzzle in accordance with claim 31 and further having tripping means for retractably thrusting into said box structure to provide an obstruction near the edge of said tumbling cube to assist in tumbling said cube.

33. A cube puzzle manipulative by a player, said cube puzzle comprising: a box structure of parallelepipedon form having four vertical sides, an upward extending arcuate top side spanning the four vertical sides and a downward extending arcuate bottom side spanning the four vertical sides and at right angle to said arcuate top side, said box structure having a cubical interior portion housing in slidable relationship 7 uniformly sized cubes in two horizontal tiers with the cubical interior portion of said box structure having a capacity to slidably house 8 of said cubes, said arcuate top and bottom sides each being in register with a full tier of cubes, and with the internal radius of curvature being slightly greater than the diagonal dimension of a face on one of said cubes, said arcuate sides each forming a tumble chamber for tumbling one of said cubes at the option and control of said player.

34. A cube puzzle in accordance with claim 33 and further having tripping means for retractably thrusting into said box structure to provide an obstruction near the edge of said tumbling cube to assist in tumbling said cube.

35. A cube puzzle manipulative by a player, said cube puzzle comprising: a box structure of parallelepipedon form having four vertical sides including a front side, a top horizontal side and a bottom horizontal side forming a hollow rectangular interior housing in slidable relationship a predetermined number of uniformly sized cubes in at least one horizontal tier, the number of cubes being at least one less than the housing capacity of said rectangular interior, a portion of said box structure immediately adjacent to the upper portion of said front side and the adjacent portion of said top side being open, said box structure having a first arched band joined to and horizontally extending from the open portion of said box structure, and a second arched band vertically extending from the open portion of said box structure, said arched bands being positioned to leave an opening between said bands in communication with the rectangular interior of said box structure, each of said arched bands having an internal radius of curvature slightly greater than the diagonal dimension of a face on one of said cubes and forming a tumble chamber in which a selected cube may be rotated from one face to an adjacent face thereon by said player manipulating said selected cube through the opening between said bands.

* * * * *